US010066399B2

(12) United States Patent
Johnson

(10) Patent No.: US 10,066,399 B2
(45) Date of Patent: Sep. 4, 2018

(54) LATH STAPLING SYSTEM

(71) Applicant: MORTAR NET USA, LTD., Burns Harbor, IN (US)

(72) Inventor: Gary R. Johnson, Gary, IN (US)

(73) Assignee: Innovation Calumet LLC, Valparaiso, IN (US)

( * ) Notice: Subject to any disclaimer, the term of this patent is extended or adjusted under 35 U.S.C. 154(b) by 85 days.

(21) Appl. No.: 14/848,257

(22) Filed: Sep. 8, 2015

(65) Prior Publication Data

US 2016/0069084 A1 Mar. 10, 2016

Related U.S. Application Data

(60) Provisional application No. 62/047,198, filed on Sep. 8, 2014.

(51) Int. Cl.

| | |
|---|---|
| ***E04F 13/04*** | (2006.01) |
| ***E04F 13/06*** | (2006.01) |
| ***E04F 13/08*** | (2006.01) |
| ***B21D 53/00*** | (2006.01) |
| ***E04B 1/70*** | (2006.01) |
| ***E04B 1/66*** | (2006.01) |
| *E04B 2/84* | (2006.01) |

(52) U.S. Cl.

CPC ..... *E04F 13/045* (2013.01); *E04B 1/665* (2013.01); *E04B 1/7038* (2013.01); *E04B 2/845* (2013.01); *E04F 13/04* (2013.01); *E04F 13/068* (2013.01)

(58) Field of Classification Search

CPC ..... E04F 13/045; E04F 13/047; E04F 13/06; E04F 13/068; E04F 13/04; E04F 13/08; B21D 53/00; Y10T 29/49623; Y10T 29/49629; Y10T 428/249962; E04B 2/845; E04B 1/665; E04B 1/7038

USPC ..... 29/897.3, 897.32; 227/110, 111, 140, 227/154

See application file for complete search history.

(56) References Cited

U.S. PATENT DOCUMENTS

| | | | | |
|---|---|---|---|---|
| 3,339,265 A * | 9/1967 | Powers | B25B 27/146 | 227/83 |
| 3,339,448 A * | 9/1967 | McKee | E04F 13/045 | 411/473 |
| 5,287,673 A * | 2/1994 | Kreikemeier | E04F 13/04 | 52/663 |
| RE36,676 E * | 5/2000 | Sourlis | E04B 1/644 | 52/169.5 |
| 6,684,579 B2 * | 2/2004 | Brunson | E04B 1/7061 | 52/169.14 |
| 6,918,222 B2 * | 7/2005 | Lat | B25C 5/0257 | 411/470 |

(Continued)

*Primary Examiner* — Bayan Salone

(74) *Attorney, Agent, or Firm* — McDonnell Boehnen Hulbert & Berghoff LLP

(57) ABSTRACT

A cost-effective and expeditious method for attaching a water channel layer to lath pre-installation, for subsequent application to an inner wall structure, increasing the efficiency and decreasing the cost of building construction, and also encompasses the stock material made thereby. In one form, there is a stapling frame equipped to be placed in juxtaposition to a water channel layer atop a layer of lath on and adjacent surface. A plurality of staplers mounted to the frame then combine the water channel layer and lath to form an integrated stock material that can then be used in a wall structure.

20 Claims, 5 Drawing Sheets

(56) References Cited

U.S. PATENT DOCUMENTS

| | | | | |
|---|---|---|---|---|
| 7,490,401 | B2 * | 2/2009 | Mossbeck | B21F 15/04 227/100 |
| 9,366,033 | B2 * | 6/2016 | Johnson | E04F 13/04 |
| 2005/0053448 | A1 * | 3/2005 | Lat | B25C 5/0257 411/470 |
| 2005/0251981 | A1 * | 11/2005 | Mossbeck | B21F 15/04 29/91.1 |
| 2006/0011696 | A1 * | 1/2006 | Mossbeck | B21F 15/04 227/140 |
| 2007/0261365 | A1 * | 11/2007 | Keene | E04F 13/04 52/796.1 |
| 2009/0208684 | A1 * | 8/2009 | Dunleavy | B29C 70/10 428/36.4 |
| 2013/0276392 | A1 * | 10/2013 | Johnson | E04F 13/04 52/302.1 |

* cited by examiner

LATH STAPLING SYSTEM

CROSS-REFERENCE TO RELATED APPLICATIONS

The present application claims priority from U.S. Provisional Application No. 62/047,198, filed Sep. 8, 2014, which is incorporated by reference herein in its entirety.

FIELD OF THE INVENTION

This invention generally relates to lath, and more particularly to a stapling system for affixing a drainage material to lath.

BACKGROUND OF THE INVENTION

The use of hard coat stucco has been employed as a building material since literally ancient days. For stucco and plaster applications, a lath or mesh substrate is typically applied to the surface of the wall or ceiling structure. This provides a base for mechanical holding or keying for the unhardened stucco or plaster. Metal lath is often used as the reinforcement when stucco or plaster is applied over open frame construction, sheathed frame construction, or a solid base having a surface that might otherwise provide an unsatisfactory bond for the stucco or plaster. Plastic and other kinds of lath have also been used. When applied over frame construction, one may often employ base coats of plaster with a total thickness of approximately ⅜ inch to approximately ¾ inch to produce a solid base for a decorative finish coat.

According to the International Conference of Building Officials Acceptance Criteria for Cementitious Exterior Wall Coatings, AC 11, effective Oct. 1, 2002, and evaluation report NER-676, issued Jul. 1, 2003, wire fabric lath should be a minimum of No. 20 gauge, inch (25.4 mm) (spacing) galvanized steel woven-wire fabric. The lath should be self-furred, or furred when applied over all substrates except unbacked polystyrene board. Metal lath has structural integrity, but if made of steel can corrode over time. The metal can also unfavorably react with the chemistry of the plaster or stucco. Hence, plastic or non-metal lath has gained popularity.

Stone veneer has also gained in popularity. Mounting of stone veneer using lath can present similar issues to that of plaster and stucco. A concern with the stone veneer, and even stucco, is that moisture can find its way behind the outer stone or stucco surface. This can present itself by way of hole penetrations in putting up the lath, and water condensing or otherwise migrating behind the lath.

Also, a matrix of randomly oriented plastic or other durable fibers which are relatively rigid, or which can be treated to be relatively rigid or organized into a matrix that is relatively rigid, has been employed as the lath. An example of the foregoing kind of material is sold under the name MORTAR NET, sold by Mortar Net, Inc. of Burns Harbor, Ind., and such as disclosed in U.S. Pat. No. Re. 36,676. Such a matrix lath has typically been on the order of around except ¼" thick (in front-to-back width).

Mortar Net, Inc. has created a system to allow water which may have penetrated cracks in the stucco or between the mortar and veneer to drain out, and to prevent water from entering the structure. To that end, a layer that forms a water channel layer has been applied in combination with the lath. The water channel layer has typically been of material similar to that of the foregoing matrix lath, but of a smaller fibrous diameter entangled randomly-oriented plastic or other durable fiber, formed in a thinner width, such as 3/16" or ¼" WALLNET product, made or sold under that name by Mortar Net, Inc. from stock material made by the Fiber Bond Corporation. More details of the foregoing system and product can be gleaned from U.S. application Ser. No. 13/838,993, filed Mar. 22, 2013.

SUMMARY OF THE INVENTION

An improvement on the foregoing water channel and lath combination is to combine the water channel layer with the lath prior to its installation, as on an inner wall structure. The combination results in a stock material that enables easier, faster installation compared to individual lath and drainage components being assembled in situ. Further, the combination of the two layers can reduce penetrations to other layers or elements of the wall structure which are not desired to necessarily be punctured (leading to water entry points, for instance).

The implementations discussed herein are a cost-effective and expeditious way of attaching a water channel layer to lath pre-installation, for subsequent application to an inner wall structure, increasing the efficiency and decreasing the cost of building construction.

In one example, a water channel layer is placed in contact (as in vertically atop) a layer of lath. The surface area of the water channel layer may preferably be less than that of the lath, such that a region of lath remains exposed along at least one long edge and one short edge of the water channel layer. This enables ready overlap of completed combined lath-and-water channel layer constructs in wall construction.

A stapling mechanism then lowers, such as vertically from an original vertical resting position above the water channel layer applied to the lath surface, to the top surface of the water channel layer at one or more predetermined positions on the surface of the water channel layer, and inserts one staple at the predetermined position or each of the predetermined positions, such that the head of the applied staple or staples is on the surface of the water channel layer and the ends are clinched to engage the backside of the lath (i.e., the side not in contact with the water channel material). The staple or staples may engage in an outward clinch (that is, the staple legs are bent outwardly), such that the bend returns the tip of the staple approximately to the top surface of the water channel layer while engaging the wire of the lath. The lath and water channel layer need not be horizontally oriented for fixation together, but this is currently deemed most desirable.

In one embodiment, the stapling frame uses multiple pneumatically operated staplers on a frame. The staplers are located to be inboard from the edge of the water channel layer and spaced about the combined water channel layer/lath. The staplers may be simultaneously engaged to perform the stapling operation. The stapling mechanism then rises vertically to its vertical resting position while the water channel layer and lath combination is removed and new, separate rectangular portions of water channel layer and lath of equivalent dimensions to the previous portions are placed in position. The frame could also be hinged along one side to open and receive the combined water channel layer/lath in a clamshell arrangement. Further, the frame could move, in a plane above (or below) the water channel layer/lath, into position for stapling.

The water channel layer may optionally be 0.25" or 0.40" thick, among other possible sizes. The staplers may optionally be positioned to apply one or more staples at the predetermined position(s) evenly spaced along the length of rectangular sections ("sheets") of water channel layer and lath at a predetermined distance inward from the edge of the surface of the water channel layer. The staplers are preferably positioned to apply one or more staples at predetermined position(s) generally evenly spaced along the width of the rectangular portions of water channel layer and lath at a predetermined distance inward from the edge of the surface of the water channel layer. Although systems using pneumatically operated staplers are discussed herein, many kinds of staplers are available.

In an alternative embodiment, a rectangular portion of water channel layer, approximately 25.5 inches width by 95.5 inches length, is placed vertically atop of a rectangular portion of lath of approximately 27 inches width by 97 inches length such that the water channel layer and lath are flush along one length and one adjacent width, and along the other length and adjacent width of lath, approximately 1.5 inches of surface area of lath is exposed beyond the edge of the water channel layer.

In an alternative embodiment, the stapling frame may be a generally solid surface equipped with one or more staplers engaged to deliver staples through apertures in the surface of the frame. The stapling frame is equipped to slide horizontally over an adjacent surface carrying the combined water channel layer atop a layer of lath on such adjacent surface. The frame may be positioned such that it slides over the combined water channel layer/lath just above the same, or it could be slightly lowered once in position, to thereby compress the combined materials. The staplers may then be simultaneously engaged to deliver staples through the apertures in the surface of the frame such that the heads of the applied staples are on the top surface of the water channel layer and the ends of the applied staple are clinched such as to engage the lath. The stapling frame may then slide horizontally to its original starting position so that the attached rectangular portions of water channel layer and lath may be removed and new, separate rectangular portions of water channel and lath may be inserted.

DETAILED DESCRIPTION

Figure 1:
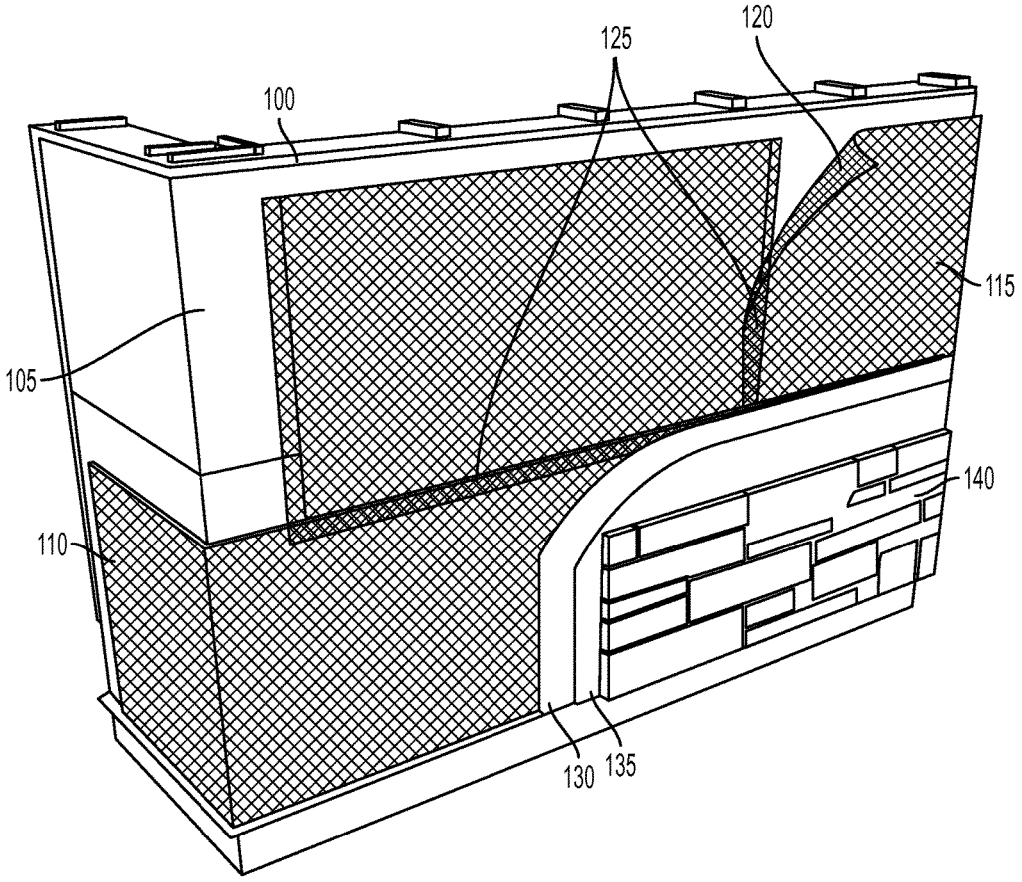
FIG. 1 is a perspective view of a wall structure with lath and water channel layers made by an example stapling system, as applied to a frame construction.

Referring now to FIG. 1 in particular, a wall structure with lath and water channel layers previously stapled together by the method discussed herein is depicted. The inner wall is typical, but not limited, to that shown here as using a CMU wall structure. Additionally, the elements shown need not be employed in the exact order shown in FIG. 1. The systems and methods discussed herein are directed to combining the water channel layer and lath to yield a stock material for later installation with whatever wall structure is desired, regardless of whether water channel layer 120 surface or lath 115 surface is selected as the outboard surface. A wood (stud) wall structure and others may be used, of course.

Outboard of an exterior-grade sheathing 100 is a weather resistive barrier 105, which may be a heavy-duty plastic sheeting, operating as a moisture barrier. Outboard of the weather resistive barrier 105 is the lath-and-water channel layer combination 110. The lath-and-water channel layer combination 110 is in this illustrative embodiment applied to the sheathing in a conventional manner such that the lath 115 is outboard to the water channel layer 120 and affixed to the sheathing.

The water channel layer 120 material may be, as noted previously, a fibrous diameter entangled randomly oriented plastic or other durable fiber, formed in a thinner width, such as 3/16" or 1/4" WALLNET product, made or sold under that name by Mortar Net, Inc. The lath 115 may be any commonly used which is readily combinable with the water channel material by stapling, as hereinafter discussed. There are many known types of lath, including metal and plastic being most commonly used. Fiberglass lath, typically supplied in continuous rolls, may be used. The lath serves as the main supporting structure for receiving and holding plaster or stucco, or some cementitious or other adhesive compound for holding thin stone veneer or stucco finish coat 140, and may be outboard to the water channel layer 120 as shown here, or inboard to the water channel layer 120.

FIG. 1 shows the lath 115 peeled back to illustrate the water channel layer 120. The surface area of the water channel layer 120 may preferably be less than that of the lath 115 such that a region of lath 115 is exposed along at least one long edge and one short edge of the water channel layer 120. Consequently, one segment of the lath-and-water channel layer combination 110 may be enabled for ready overlap 125 of an adjacent segment of lath-and-water channel layer constructs, creating code-compliant lath and continuous water channel layer in one. This can also be seen in FIG. 5.

Outboard to the lath-and-water channel layer combination 110 is base coat 130. Outboard to the base coat 130 is a scratch coat 135. Finally, outboard to the scratch coat 135 is thin stone veneer or stucco finish coat 140. It will be understood that some of the foregoing elements need not be employed in the exact order shown in FIG. 1.

Figure 2A:
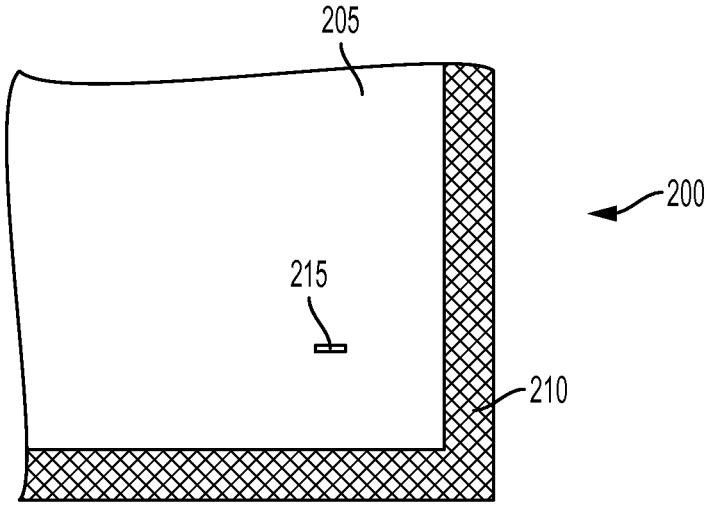
FIG. 2A is a partial corner view of a lath and water channel layer as attached by an example stapling system.
Figure 2B:
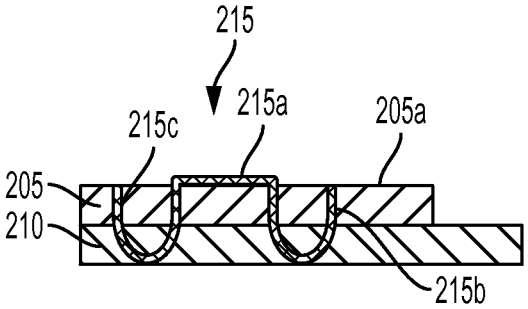
FIG. 2B shows a lath and water channel layer attached with a staple according to an example embodiment.

FIG. 2A shows a partial corner vie of an example lath-and-water channel layer combination 200. The corner view shows that the surface area of the water channel layer 205 may preferably be less than that of the lath 210, such that a region of lath exposed along at least one long edge and one short edge of the water channel layer 205. A staple 215 has been applied to the water channel layer 205, which is also shown in FIG. 2B. The head 215*a* of the staple 215 is on the top surface 205*a* of the water channel layer 205 and the two ends 215*b*, 215*c* of the applied staple 215 are clinched such as to engage the opposite side of the lath 210 (i.e., the side not in facial contact with the layer 205). Further, in the example shown in FIG. 2B, the ends 215*b*, 215*c* of the staple 215 are clinched outwardly such that each end returns approximately to the top surface 205*a* of the water channel later 205 while engaging the lath 210. As noted above the lath-and-water channel layer combination 200 may be installed such that the water channel layer 205 or the lath 210 is the outboard surface.

Figure 3:
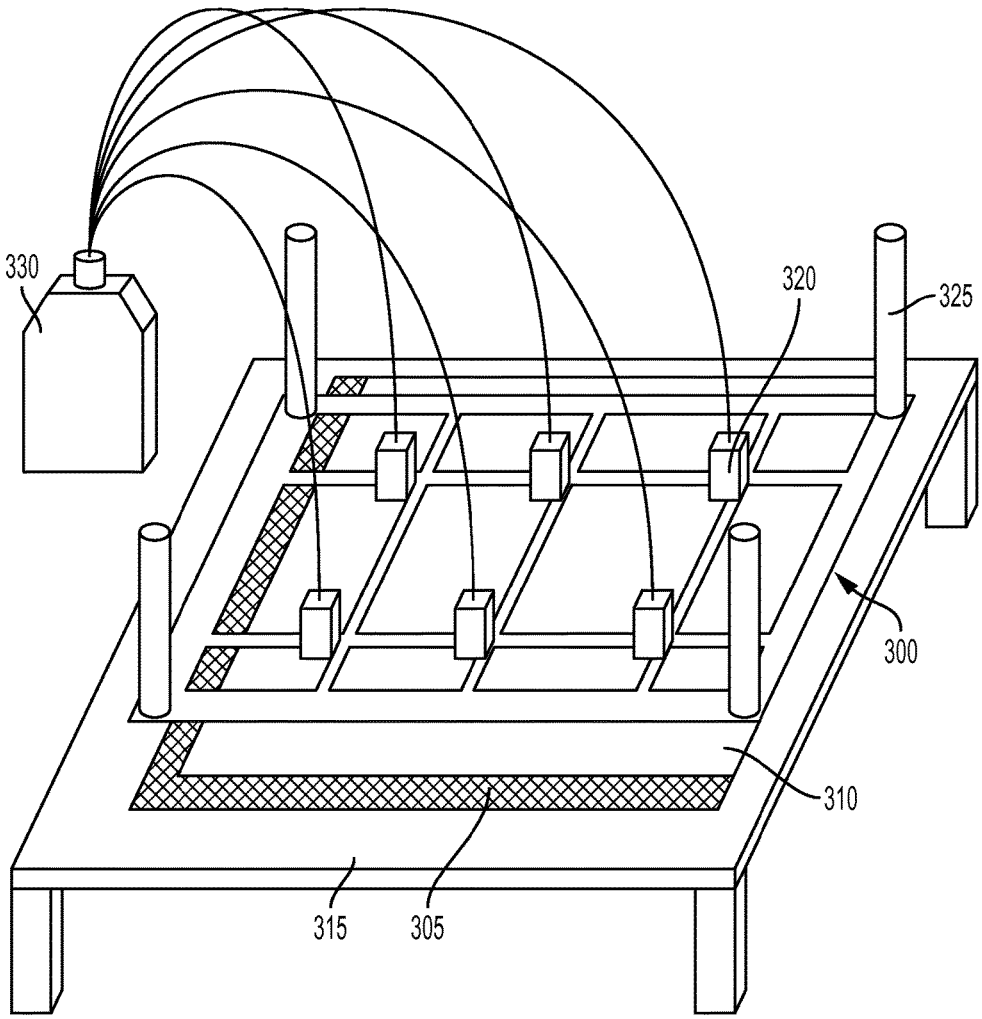
FIG. 3 is a perspective view of a stapling system according to an example embodiment, deployed to operate on lath and water channel layers atop a flat surface.

FIG. 3 shows a perspective view of the stapling system deployed to operate on lath 305 and water channel layer 310 atop a flat surface 315. The frame 300, which is equipped with one or more staplers 320 positioned at predetermined positions, is cooperatively affixed to a vertical deployment mechanism 325 providing for movement of the frame 300 towards and away from the flat surface 315. The staplers 320 may be simultaneously engaged to perform the stapling operation, although they need not be. The staplers here are pneumatically operated by cooperatively engaging the staplers 320 with pneumatic mechanism 330. The stapling system may optionally be engaged for use with fiberglass lath, which is typically supplied in continuous rolls, such that the water channel layer would be delivered to the flat surface 315 in a roll to roll process rather than sheets. The staplers and the pneumatic system along with a suitable controller are well known in the art. The arrangement of the components in this system is new.

Figure 4:
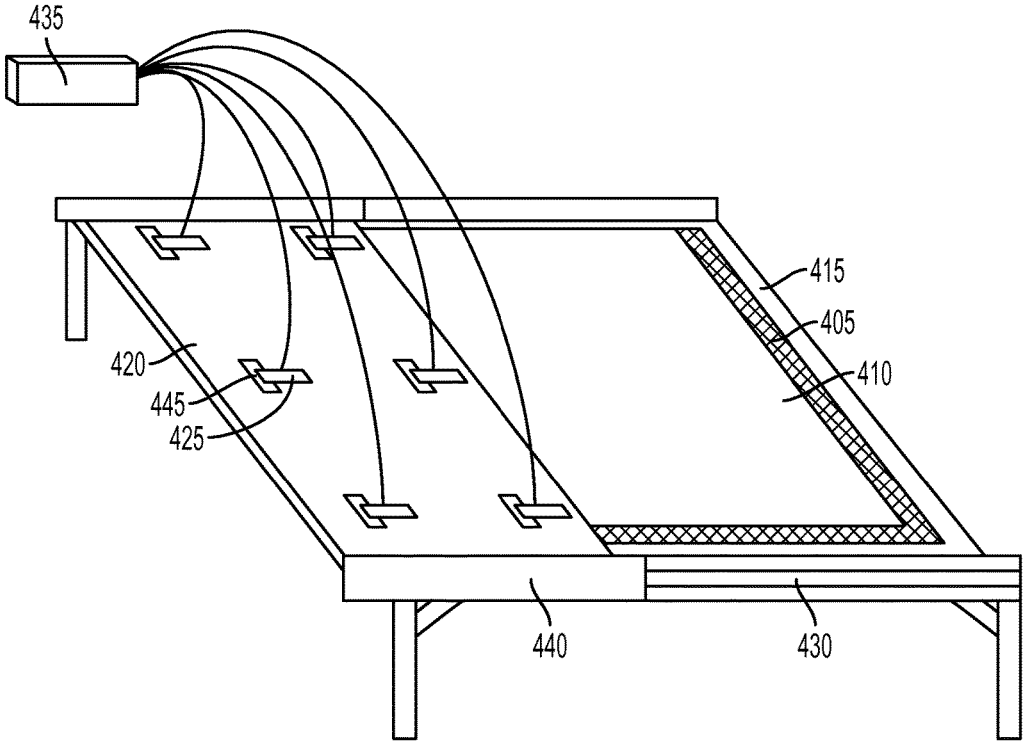
FIG. 4 is a perspective view of a stapling system according to another example embodiment, deployed to slide into position to operate on a lath and water channel layer atop a flat surface.

FIG. 4 shows a perspective view of an alternative embodiment of a stapling system deployed to operate on lath 405 and water channel layer 410 atop a flat surface 415. The stapling frame 420 is a surface equipped with one or more staplers 425 engaged to deliver staples through apertures 445 in the surface of the stapling frame 420. The stapling frame 420 is equipped on its ends 440 to slide horizontally via a sliding mechanism 430 over the adjacent flat surface 415, and over a rectangular portion of water channel layer 410 atop a rectangular portion of lath 405 on such adjacent flat surface 415. The staplers 425 may then be simultaneously engaged to deliver staples through the apertures 445 in the surface of the stapling frame 420 such that the heads of the applied staples are on the top surface of the water channel layer 410 and the ends of the applied staples are clinched such as to engage the lath 405. The stapling frame 420 may then slide horizontally to its original starting position so that the attached rectangular portions of water channel layer 410 and lath 405 may be removed and new, separate rectangular portions of water channel layer 410 and lath 405 may be inserted atop the flat surface 415. The staplers may optionally be pneumatically operated by cooperatively engaging the staplers 425 with pneumatic mechanism 435.

In one alternative to the foregoing, a more open frame could be used for mounting the staplers, as described with the first embodiment. In another alternative to the foregoing, the stapling system may be engaged for use with fiberglass lath, which is typically supplied in continuous rolls, such that the water channel layer would be delivered to the flat surface 415 in a roll to roll process rather than sheets.

Figure 5:
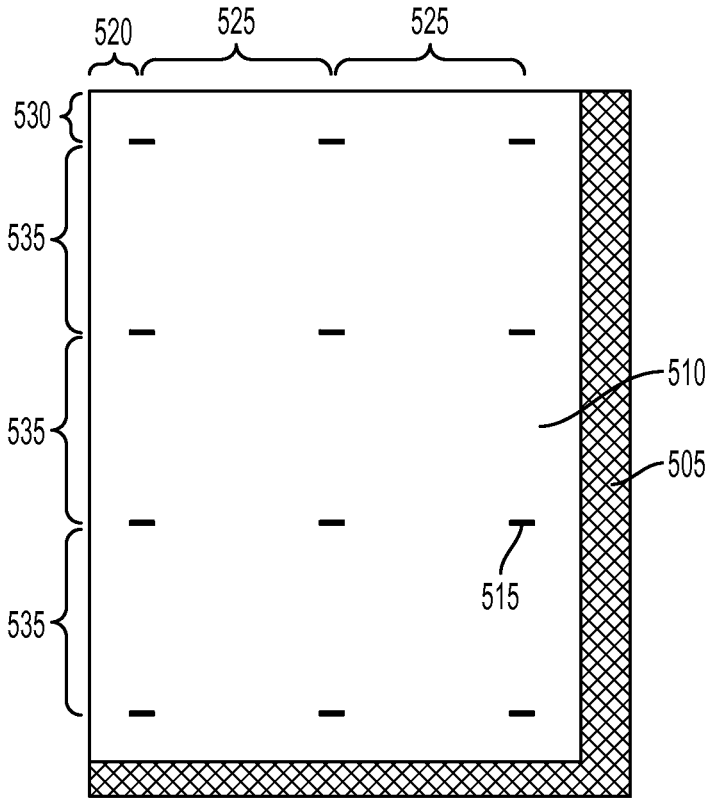
FIG. 5 is a lath and water channel layer combined into an integrated unit via staples, according to an example embodiment.

FIG. 5 shows a lath 505 and water channel layer 510 combined into an integrated unit via staples 515. The staples 515 are generally evenly spaced along the width of the integrated unit, as shown by the spacing 525 between each staple 515. Further, the staples 515 begin at predetermined distance 520 from inward from the long edge of the water channel layer 510. Similarly, the staples 515 are generally evenly spaced along the length of the integrated unit, as shown by the spacing 535 between each staple 515. Further, the staples 515 begin at predetermined distance 530 from inward from the short edge of the water channel layer 510.

While the present invention has been described with respect to certain embodiments, numerous changes and modifications will be apparent to those of skill in the art, and such changes and modifications are intended to be encompassed within the spirit of the invention, as defined by the claims.

What is claimed is:

1. A method for attaching a water channel layer to a lath, comprising:

placing the water channel layer atop the lath such that a first side of each and an adjacent second side of each are flush, wherein the lath extends past the water channel layer for a predetermined distance at a third side and an adjacent fourth side, and wherein the lath is formed from a matrix of fibers forming openings in the lath member sufficient to provide keying for cementitious material;

lowering a stapling; mechanism vertically from an original vertical resting position to a top surface of the water channel layer;

inserting one or more staples, each staple comprising a head and two ends, at one or more predetermined positions on the top surface of the water channel layer such that the head of each staple is on the top surface of the water channel layer and the ends of each staple are clinched so as to engage the lath; and raising the stapling mechanism vertically to its original vertical resting position.

2. The method of claim 1, wherein the stapling mechanism is positioned to simultaneously apply one or more staples evenly spaced along a length of the water channel layer and lath at a predetermined distance inward from the first side of the water channel layer, and to apply one or more staples evenly spaced along a width of the water channel layer and lath at the predetermined distance inward from the second side of the water channel layer.

3. The method of claim 1, wherein the one or more staples are outwardly clinched such that the ends of each staple are returned approximately to the top surface of the water channel layer while engaging the lath.

4. The method of claim 1, wherein the stapling mechanism is cooperatively engaged with a pneumatic pressure mechanism such that the one or more staples are applied to the water channel layer and lath using pneumatic pressure.

5. A method for attaching a water channel layer to a lath to form a stock material, comprising:

placing a water channel layer in facial engagement with a lath, wherein the water channel layer and the lath are overlaid, wherein a surface area of water channel layer is less than a surface area of the lath, wherein a region of lath extends beyond at least one long edge and one short edge of the water channel layer, and wherein the lath is formed from a matrix of fibers forming openings in the lath member sufficient to provide keying for cementitious material;

positioning the water channel layer and the lath within a stapling mechanism having a frame and a plurality of staplers mounted to the frame in a preset arrangement, wherein the frame is movably mounted to the stapling mechanism so as to position the staplers for stapling;

inserting a plurality of staples, each staple comprising a head and two ends, into a top surface of the water channel material to thereby join the overlaid water channel layer and lath into an integrated unit; and moving the frame away from the integrated unit.

6. The method of claim 5, wherein the plurality of staplers is mounted to the frame so as to simultaneously apply staples evenly spaced along a length of the water channel layer and lath at a predetermined distance inward from a first side of the water channel layer, and to apply staples evenly spaced along a width of the water channel layer and lath at the predetermined distance inward from a second side of the water channel layer.

7. The method of claim 5, wherein each staple in the plurality staples is outwardly clinched such that the ends of the staple are returned approximately to the top surface of the water channel layer while engaging the lath.

8. The method of claim 5, further comprising:

removing the integrated unit from the stapling mechanism; and depositing the integrated unit onto a roll.

9. The method of claim 5, wherein the frame comprises a plurality of apertures, and wherein inserting the plurality of staples into the top surface of the water channel material comprises inserting the plurality of staples through the plurality of apertures in the frame.

10. The method of claim 5, further comprising horizontally sliding the frame over the overlaid water channel layer and lath before inserting the plurality of staples.

11. The method of claim 1, wherein the predetermined distance is 1.5 inches at the third side and the adjacent fourth side.

12. The method of claim 5, wherein placing the water channel layer in facial engagement with the lath comprises placing the water channel layer such that the region of lath extends a predetermined distance beyond the at least one long edge and one short edge of the water channel layer, and wherein the at least one long edge and one short edge of the water channel layer are adjacent edges.

13. The method of claim 12, wherein the predetermined distance is about 1.5 inches.

14. A method for attaching a water channel layer to a lath to form a stock material, comprising:

placing a water channel layer in facial engagement with a lath, wherein the water channel layer and the lath are overlaid;

positioning the water channel layer and the lath within a stapling mechanism having a frame and a plurality of staplers mounted to the frame in a preset arrangement, wherein the frame is movably mounted to the stapling mechanism so as to position the staplers for stapling;

inserting a plurality of staples, each staple comprising a head and two ends, into a top surface of the water channel material to thereby join the overlaid water channel layer and lath into an integrated unit, wherein the frame comprises a plurality of apertures, and wherein inserting the plurality of staples into the top surface of the water channel material comprises inserting the plurality of staples through the plurality of apertures in the frame; and moving the frame away from the integrated unit.

15. The method of claim 14, wherein the plurality of staplers is mounted to the frame so as to simultaneously apply staples evenly spaced along a length of the water channel layer and lath at a predetermined distance inward from a first side of the water channel layer, and to apply staples evenly spaced along a width of the water channel layer and lath at the predetermined distance inward from a second side of the water channel layer.

16. The method of claim 14, wherein each staple in the plurality staples is outwardly clinched such that the ends of the staple are returned approximately to the top surface of the water channel layer while engaging the lath.

17. The method of claim 14, further comprising:

removing the integrated unit from the stapling mechanism; and depositing the integrated unit onto a roll.

18. The method of claim 14, further comprising horizontally sliding the frame over the overlaid water channel layer and lath before inserting the plurality of staples.

19. The method of claim 14, wherein a surface area of the water channel layer is less than a surface area of the lath, wherein a region of lath extends beyond at least one long edge and one short edge of the water channel layer.

20. The method of claim 14, wherein placing the water channel layer in facial engagement with the lath comprises placing the water channel layer such that the region of lath extends a predetermined distance beyond the at least one long edge and one short edge of the water channel layer, and wherein the at least one long edge and one short edge of the water channel layer are adjacent edges.

* * * * *